US011138909B2

(12) United States Patent
Sisko et al.

(10) Patent No.: US 11,138,909 B2
(45) Date of Patent: Oct. 5, 2021

(54) ELECTRONIC SHELF LABEL MOUNTING SYSTEM AND METHOD

(71) Applicant: K-International, Inc., Waukegan, IL (US)

(72) Inventors: Michael L. Sisko, Ripon, WI (US); Michael J. White, Ripon, WI (US)

(73) Assignee: K-International, Inc., Waukegan, IL (US)

( * ) Notice: Subject to any disclaimer, the term of this patent is extended or adjusted under 35 U.S.C. 154(b) by 0 days.

(21) Appl. No.: 16/589,675

(22) Filed: Oct. 1, 2019

(65) Prior Publication Data

US 2021/0097897 A1 Apr. 1, 2021

(51) Int. Cl.

| | |
|---|---|
| ***G09F 3/20*** | (2006.01) |
| ***A47F 5/00*** | (2006.01) |
| ***A47F 5/08*** | (2006.01) |

(52) U.S. Cl.

CPC ..... *G09F 3/204* (2013.01); *A47F 5/0068* (2013.01); *A47F 5/0869* (2013.01); *G09F 3/208* (2013.01)

(58) Field of Classification Search

CPC ..... G09F 3/204; G09F 3/208; A47F 5/0068; A47F 5/0869

See application file for complete search history.

(56) References Cited

U.S. PATENT DOCUMENTS

| | | | | |
|---|---|---|---|---|
| 6,035,569 | A | 3/2000 | Nagel et al. | |
| 6,119,990 | A | 9/2000 | Kump et al. | |
| 6,553,702 | B1 | 4/2003 | Bacnik | |
| 6,935,062 | B2 | 8/2005 | Lowry et al. | |
| 7,455,081 | B2 | 11/2008 | Bacnik | |
| 2001/0030273 | A1* | 10/2001 | Veazey | G09F 7/18 248/475.1 |
| 2004/0060883 | A1* | 4/2004 | Walker | A47F 5/005 211/119.003 |
| 2005/0035075 | A1* | 2/2005 | Walker | A47F 5/005 211/119.003 |
| 2005/0167555 | A1* | 8/2005 | Wamsley | G09F 7/18 248/231.81 |
| 2005/0274052 | A1* | 12/2005 | Valiulis | G09F 3/204 40/661.03 |
| 2008/0282592 | A1* | 11/2008 | Brinkman | G09F 3/204 40/661.03 |
| 2010/0083544 | A1* | 4/2010 | Shirley | G09F 3/204 40/584 |
| 2011/0239501 | A1* | 10/2011 | Ricci | G09F 23/04 40/541 |

(Continued)

OTHER PUBLICATIONS

U.S. Appl. No. 16/536,596, filed Aug. 9, 2019.

*Primary Examiner* — Gary C Hoge
(74) *Attorney, Agent, or Firm* — Schiff Hardin LLP

(57) ABSTRACT

An apparatus, system and method for mounting and removing electronic shelf label (ESL) modules includes a channel having a first portion for receiving an ESL module and a second portion for receiving a display holder. A tool aids in removal of the ESL from the first portion and aids in removal of the display holder from the second portion. The display holder has an engagement edge that fits into the second channel and a sign gripper with a movable portion connected to a fixed portion. A peg on the movable portion extends through the sign and into a hole in the fixed portion.

28 Claims, 8 Drawing Sheets

(56) References Cited

U.S. PATENT DOCUMENTS

| | | | | |
|---|---|---|---|---|
| 2013/0008065 | A1* | 1/2013 | Danielson | G09F 23/06 40/606.01 |
| 2015/0170550 | A1* | 6/2015 | Jubro | G09F 3/02 40/662 |

* cited by examiner

ELECTRONIC SHELF LABEL MOUNTING SYSTEM AND METHOD

BACKGROUND OF THE INVENTION

Field of the Invention

The present invention relates generally to an apparatus and method for mounting an electronic shelf label, and more particularly to a system for mounting and unmounting an electronic shelf label and for providing an additional display associated with the electronic shelf label.

Description of the Related Art

Retail stores use shelf labels and price labels to display price information and other information about products being sold by the store. Store shelves and product displays are provided in a variety of configurations depending on the products sold, the type of store, layout of the store, and other factors. Shelf labels and price labels are mounted to the shelves or to other surfaces near the displayed products. Each change that a store wishes to make in the shelf label or price label such as to change the product information, change the product location, or to change the price of the product, a store employee or other worker must remove the old label and mount a new label at each product display location. Significant time and labor costs are involved in changing shelf labels and price labels. Workers must ensure that old price labels are not missed during the update to avoid out-of-date price and product information from being displayed to the store customers.

Electronic shelf labels (ESL) are being used in some retail stores. An electronic shelf label includes an electronic module with a display screen on which is displayed price and product information. The electronic module has a highly efficient circuit powered by a long life battery that may provide up to eight to ten years of useful life between battery changes for some electronic shelf label modules. Each electronic shelf label module is wirelessly addressable from a central location to permit the displayed product and price information to be changed as desired. Price and product information may be changed remotely without requiring that workers go to the physical location of the shelf or price label.

Mounting the electronic shelf label modules to store shelves and other store product display locations has presented challenges as stores change from paper price labels to electronic shelf labels. Flagging products that are labeled with electronic shelf labels for special attention is desirable. Electronic shelf labels may need to be moved, for example, as product displays are changed in the store, or may need to be removed for battery replacement, to replace a damaged or faulty electronic shelf label, or for other reasons.

SUMMARY OF THE INVENTION

The present invention provides an apparatus, method, and system for mounting electronic shelf labels. An optional aspect provides a display for flagging a product for special attention. An optional aspect provides a tool for removing a flag mount. An optional aspect provides a tool for removing or relocating an electronic shelf label from a mounting bracket. An optional aspect provides an electronic shelf label mounting for smaller displays, including pegboard displays.

DETAILED DESCRIPTION OF THE PREFERRED EMBODIMENTS

Figure 1:
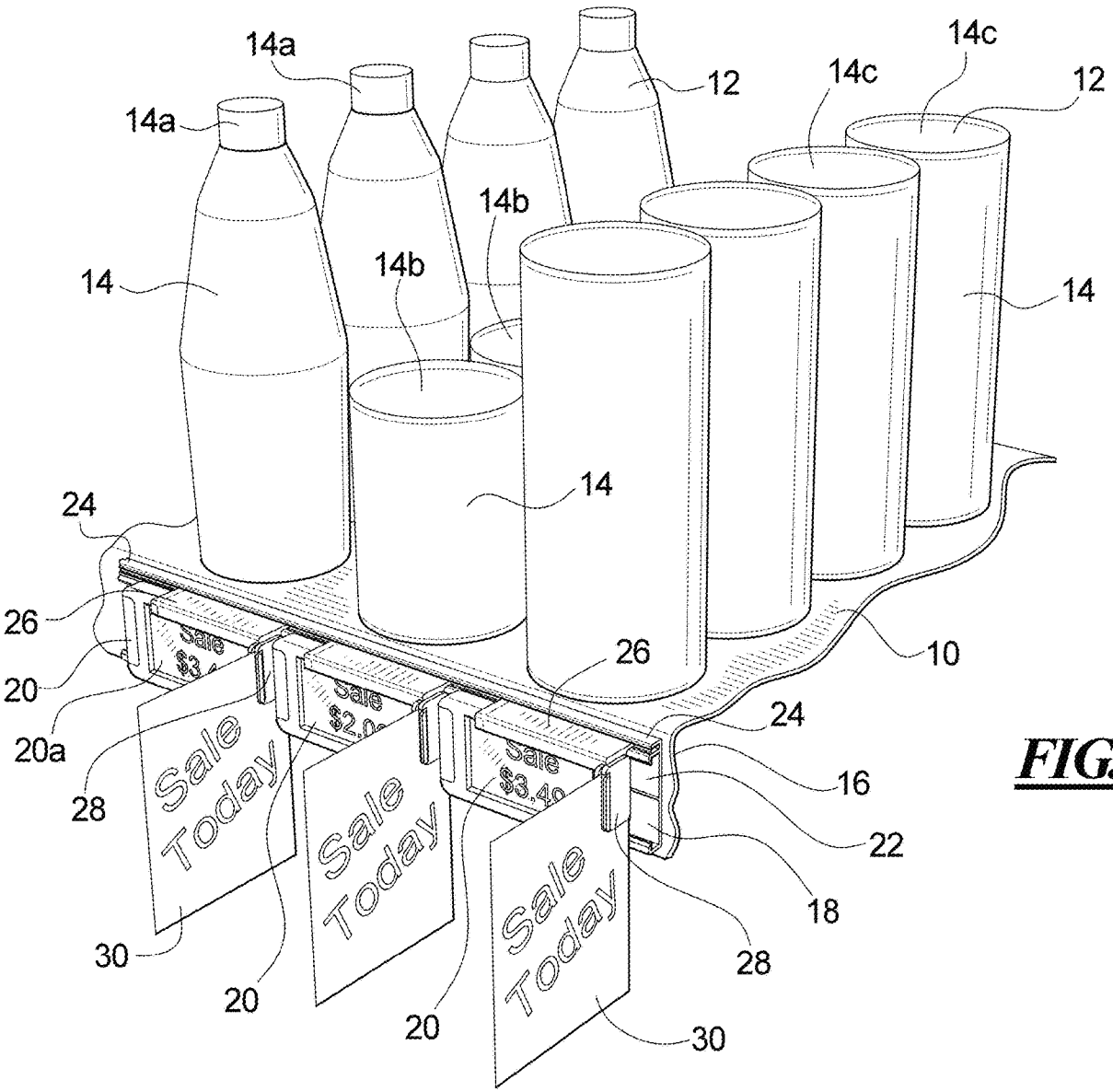
FIG. 1 is an environmental perspective view showing an embodiment of the invention in use.

Referring first to FIG. 1, a retail store or other facility has a shelf 10 on which is displayed products 12 for sale. The products 12 are arranged in rows 14 on the shelf 10. In the illustration, each row 14 is a different type of product 12, wherein the first row 14*a* is a product sold in bottles, the second row 14*b* is a product sold in short cylindrical containers, and the third row 14*c* is a product sold in tall cylindrical containers. The shelf 10 has a front plate 16 extending downwardly from the top of the shelf 10. The front plate 16 of the illustrated shelf 10 is a vertically oriented flat plate. In alternate embodiments, the front plate can be angled outward or have other shapes. Other configurations and shapes of shelves are possible including a shelf that includes an angled front C-channel or price channel or other configuration. Store shelves are commonly formed of painted steel, although wood or other materials are of course possible.

A channel 18 is affixed to the front plate 16. The channel 18 includes an elongated body having a uniform shape along its length. The channel 18 may be formed by extrusion, for example, and may be of a plastic material that is rigid to securely hold an electronic shelf label module in the channel 18 and yet flexes when an electronic shelf label module 20 is inserted into or removed from the channel 18. The channel 18 may be affixed to the front plate 16 by one or more fasteners. In an example, the fastener includes double-sided foam tape 34 (see FIG. 2). One side of the double-sided foam tape 34 may be affixed to the back of the channel 18. A cover is provided over the adhesive on the other side of the double-sided tape 34. The cover is removed from the adhesive prior to applying the tape 34 onto the front plate 16 to affix the channel 18 onto the shelf 10. Other fastening devices or methods for affixing the channel 18 to the shelf 10 may be provided and are within the scope of this invention.

The channel 18 is configured to receive and hold one or more electronic shelf label modules 20 in a first portion 22. Each electronic shelf label module 20 that has a housing containing a display 20*a*, electronics, a battery, an antenna, and a wireless receiver. Other elements may be provided as well, including lights or sensors. The display 20*a* on the front of the housing is configured for displaying product and price information. The display 20*a* may of a type that does not draw power to display information but only requires energy to change the displayed information. One example of such a display 20*a* is referred to as electronic paper. The electronic shelf modules 20 use little power. Examples of electronic shelf label modules 20 may operate for years on a battery with some examples operating for eight or more years on a battery. The antenna and wireless receiver enables a store or other facility to wirelessly transmit signals to the electronic shelf label module 20 to update the product or price information shown on the display 20*a*. Each electronic shelf label module 20 is individually addressable by the store or other facility so that the displayed information may be adjusted separately for each product 12 as desired.

In the side-by-side rows arrangement of the products 12, a separate electronic shelf label module 20 is provided at the front of each row 14*a*, 14*b* and 14*c*. The electronic shelf label modules 20 show different price and product information for the different products 12 in each row 14*a*, 14*b* and 14*c*. As a result of the side-by-side arrangement of the rows 14, the electronic shelf label modules 20 are mounted side-by-side in the first portion 22 of the channel 18. The side-by-side arrangement may result in little or no space between the modules 20. Should store personnel seek to display additional information about the products 12, such as announcing that a product is on sale, that a product is a new, that a product is now available in a different flavor or color, is made with different ingredients or other gas another different feature, that a product is subject to a special promotion, or to provide any other information, the side-by-side arrangement of the electronic shelf label modules 20 prevents any such information from being mounted in the first portion 22 of the channel 18 between the electronic shelf label modules 20.

To enable a sign or display to be added at a product row 14, the channel 18 which holds the electronic shelf label modules 20 is provided with a display mounting channel 24. The display mounting channel 24 is connected to the first portion 22 of the channel 18 and may be formed in one piece with the first portion 22 of the channel 18, for example, during extrusion. The display mounting channel 24 extends parallel to the first portion 22. In the illustrated example, the channel 18 has been mounted with the display mounting channel 24 above the first portion 22 in which the electronic shelf label modules 20 are mounted. The channel 18 may be inverted to that it is mounted with the display mounting channel 24 below the first portion 22 that holds the electronic shelf label modules 20.

A display holder 26 may be mounted in the display mounting channel 24. Three display holders 26 are shown, one for each of the rows 14*a*, 14*b* and 14*c*. The display holder 26 includes a sign gripper 28 which may hold a sign or display 30. The display holder 26 may be positioned above the electronic shelf label module 20 as shown without requiring space in the first portion 22 of the channel 18 for a sign or display. The display holder 26 may also be mounted adjacent to the electronic shelf label module 20, or, if the channel 18 is mounted in an inverted position, may be mounted below the electronic shelf label module 20.

Each display holder 26 is provided with a sign or display 30 that is held in the respective sign grippers 28. The signs or displays 30 are held in a flag position to flag the products for attention by customers. The signs or displays 30 are in a position for viewing as the customer looks down the store aisle so as to call attention to the products 14. The signs or displays 30 may be of any size or shape, may be formed of paper, cardboard, plastic, laminate, or other materials as desired, and may contain text, images, photographs, graphics or other information.

Figure 2:
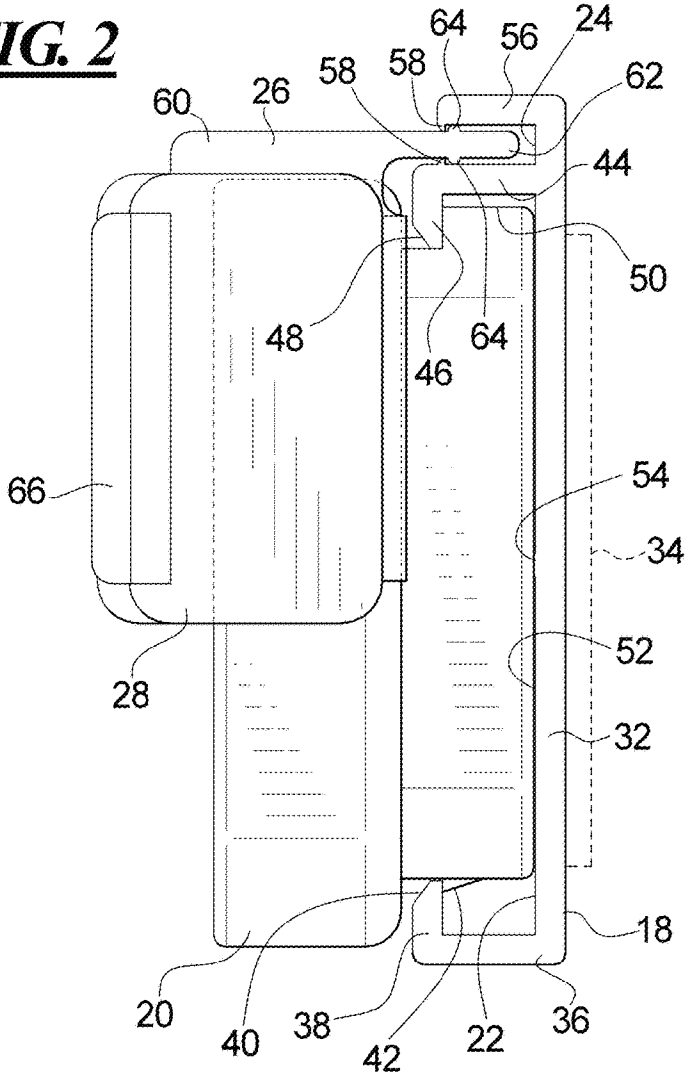
FIG. 2 is a side elevational view of a first embodiment of a channel holding an electronic shelf label module and holding a display holder.

Turning to FIG. 2, the channel 18 has the first portion 22 in which the electronic shelf label module 20 is mounted. The channel 18 also has the display mounting channel 24 in which the display holder 26 is mounted. In particular, the channel 18 has a backplane 32 that is fastened to the front plate 16 of the shelf or to another surface, such as by double-sided foam tape 34 or other fastening means. A lower ledge 36 extends perpendicular to the backplane 32 at the bottom and has an upwardly directed gripping flange 38 at its free end. A front bevel 40 is provided on the upwardly directed gripping flange 38. The front bevel 40 aids insertion of the electronic shelf label module 20 into the channel 18 and facilitates removal using a tool, as will be described later. The upwardly directed gripping flange 38 engages a catch nose 42 on the bottom of the electronic shelf label module 20.

An upper ledge 44 extends from the backplane 32 and has a downwardly directed gripping flange 46 with a forward bevel 48 that aids removal of the electronic shelf label module and aids insertion for inverted orientations of the channel 18. The downwardly directed gripping flange 46 engages an upward projection 50 of the electronic shelf label module 20. The backplane 32, lower ledge 36, upper ledge 44, and the gripping flanges 38 and 46 define an engagement space 52 into which a back portion of the electronic shelf label module 20 is fastened. A resilient fin 54 of high friction material extends from the backplane 32 to press against the back surface of the electronic shelf label module 20 to prevent sliding movement of the electronic shelf module 20 along the channel 18 and to press the electronic shelf label module 20 forward against the gripping flanges 38 and 46.

The top or outer surface of the upper ledge 44 forms one wall of the display mounting channel 24. An extension of the backplane 32 beyond the upper ledge 44 is connected to a display gripping flange 56 that is parallel to the upper ledge 44. The upper ledge 44 and the display gripping flange 56 both have gripping ribs 58 that extend inwardly into the display mounting channel 24.

The display holder 26 has a mounting plate 60 with an engagement edge 62. The engagement edge 62 is positioned within the display mounting channel 24. The mounting plate 60 has gripping ribs 64 along the top and bottom surfaces at a distance from the engagement edge 62. The gripping ribs 64 are spaced from the engagement edge 62 by less than the depth of the display mounting channel 24. The gripping 58 of the display mounting channel 24 engage the gripping ribs 64 of the display holder 26 to prevent the display holder 26 from being removed from the display mounting channel 24.

The sign gripper 28 extends downward from the mounting plate 60 and is positioned alongside the electronic shelf label module 20. The sign gripper 28 has a finger tab 66 that may be engaged by a user to release the sign or display 30 from the sign gripper 28.

Figure 3:
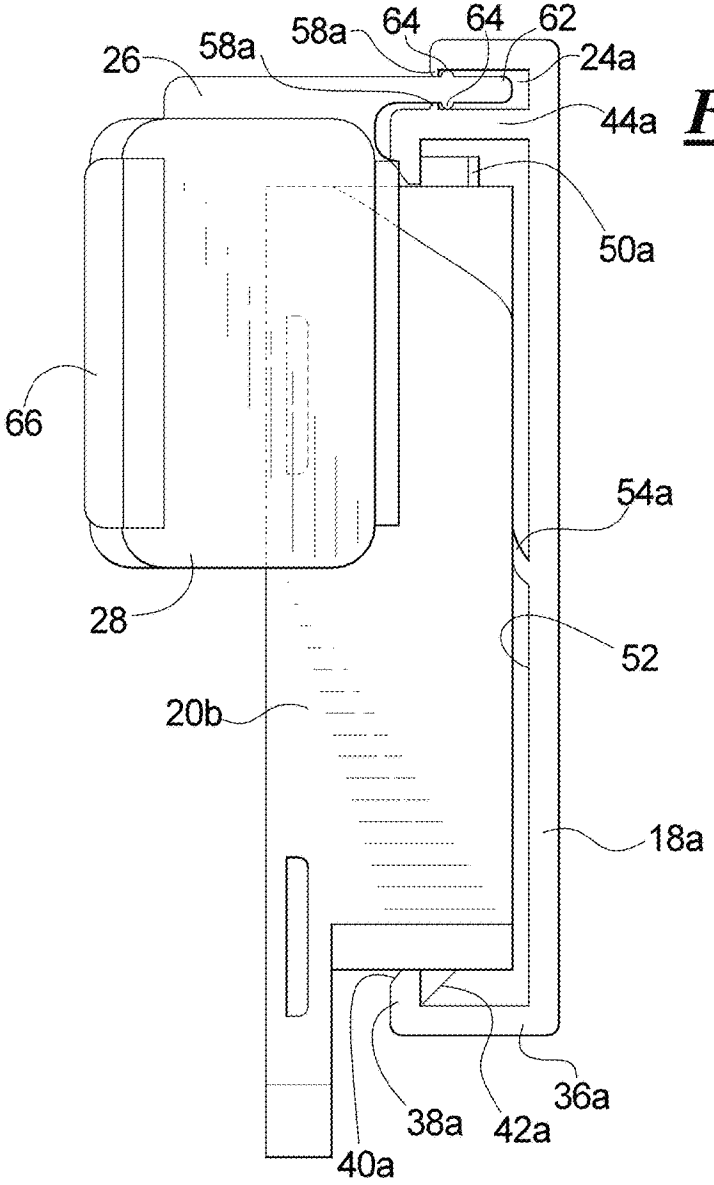
FIG. 3 is a side elevational view of a second embodiment of a channel holding an electronic shelf label module and holding a display holder.

In FIG. 3 is shown a channel 18*a* that is similar to the channel 18 except that the channel 18*a* is of a size and shape to hold an electronic shelf label module 20*b* of a different size and shape. The electronic shelf label module 20*b* may be a different model, different make, different configuration or other different electronic shelf label module 20*b* from the electronic shelf label module 20. In the illustration, the electronic shelf label module 20*b* is larger than the electronic shelf label module 20 and has a different configuration of a catch nose 42*a* than the catch nose 42 and a different configuration of an upward projection 50*a* than the upward projection 50. The electronic shelf label module 20*b* does not fit as far into the engagement space 52*a* of the channel 18*a*, as a result of which the resilient fin 54*a* is not as compressed by the electronic shelf label module 20*b* compared to the illustration in FIG. 2. The display holder 26 is mounted with the engagement edge 62 in the display mounting channel 24. Although the channel 18*a* is different to hold the different electronic shelf label module 20*b*, the display holder 26 may be the same for both the electronic shelf label module 20 and the electronic shelf label module 20*b*.

Figure 4:
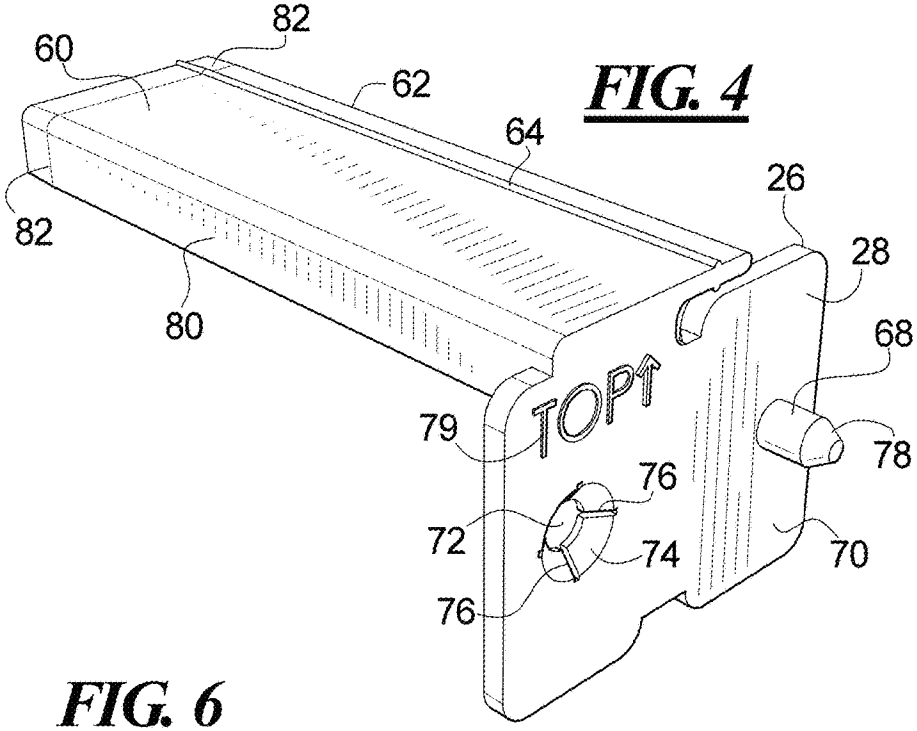
FIG. 4 is a perspective view from the top front right side of the display holder.

Turning to FIG. 4, the display holder 26 has the sign gripper 28 at an end of the mounting plate 60. The sign gripper 28 includes a peg 68 that extends from a planar surface 70. An opening 72 is formed into the planar surface 70 at an opposite side from the peg 68. The opening 72 is countersunk into the surface 70 as a result of a circular bevel 74 around the edge of the opening 72. The circular bevel 74 is provided with radial slits 76 that permit the countersunk portion of the opening to flex outward when the peg 68 is inserted into the opening 72. The radial slits 76 also permit the circular bevel 74 to flex inward when the peg 68 is being removed to thereby grip the peg 68 and prevent inadvertent opening of the sign gripper 28. The peg 68 is provided with a cone-shaped end 78 to facilitate insertion into the opening 72, as well as to form an opening in the sign or display 30 if needed. In the example, indicia 79 is provided on the planar surface 70 to indicate the mounting direction for the display holder 26. In the illustration, the indicia 79 includes an upwardly directed arrow and the word "top." The display holder 26 may be mounted in an inverted position in spite of the indicia 79.

The mounting plate 60 extends from the sign gripper 26 in a direction opposite the peg 68 and the circular bevel 74 when the sign gripper 26 is in the open position. The engagement edge 62 extends along a rear edge of the mounting plate 60. The gripping ribs 64 project from the top and bottom surfaces of the mounting plate 60 parallel to the engagement edge 62. Opposite the engagement edge 62 is a disengagement flange 80. The end of the mounting plate 60 that is opposite to the sign gripper 26 is provided with a taper 82.

Figure 5:
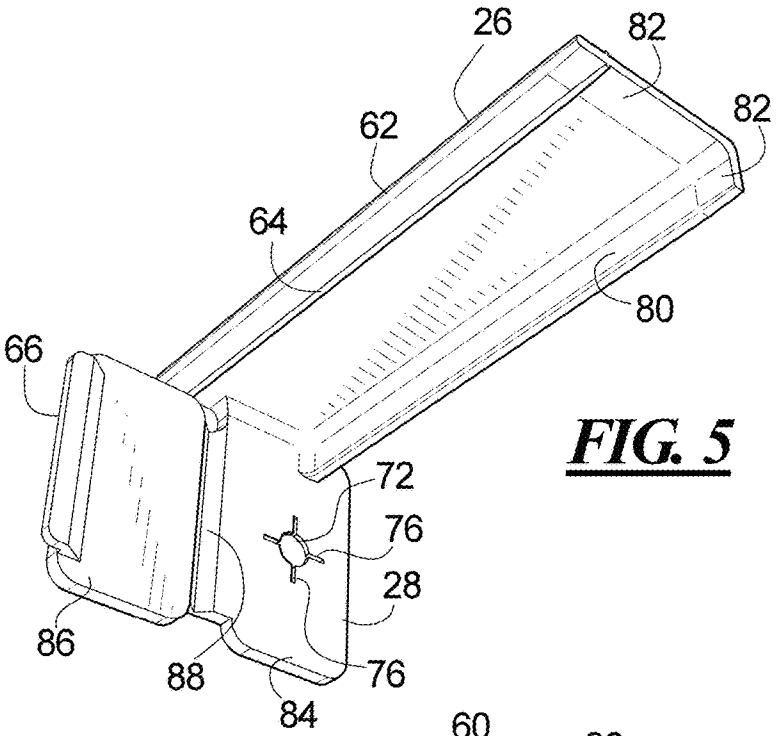
FIG. 5 is a perspective view from the bottom rear left side of the display holder.

In the view of FIG. 5, the sign gripper 28 has a fixed portion 84 that is attached to the mounting plate 60 and a movable portion 86 that is connected to the fixed portion 84 by a hinge 88. The hinge 88 permits the movable portion 86 to be pivoted toward the fixed portion 84 to insert the peg 68 into the opening 72. The movable portion 86 includes the finger tab 66 that may be grasped to pivot the movable portion 86 away from the fixed portion 84 to remove the peg 68 from the opening 72.

The mounting plate 60 has the gripping rib 64 on the underside as well as on the top side at a distance from the engagement edge 62. The disengagement flange 80 along the opposite side is L-shaped and extends downward from the mounting plate 60. The taper 82 at the end of the mounting plate 60 facilitates insertion of the engagement edge 62 into the display mounting channel 24. The taper 82 at the end of the disengagement flange 80 facilitates connecting a removal tool to the disengagement flange 80, as will be shown and described.

Figure 6:
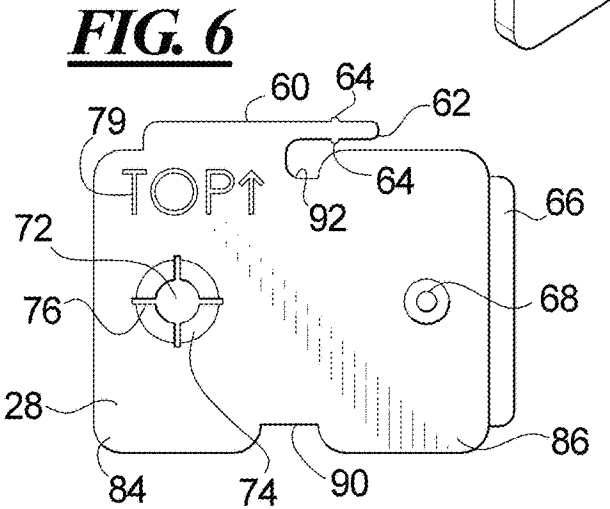
FIG. 6 is an elevational view from the right side of the display holder.

Referring to FIG. 6, the sign gripper 28 has the opening 72 extending through the fixed portion 84 and the peg 68 extending from the movable portion 86. A lower notch 90 and an upper notch 92 are between the fixed portion 84 and the movable portion 86 at the hinge 88. The mounting plate 60 is attached to the fixed portion 84 but is not attached to the movable portion 86. This permits the movable portion 86 to be moved independently of the mounting plate 60. The engagement edge 62 of the mounting plate 60 is above the movable portion 86 when the movable portion 86 is in the open position as shown.

Figure 7:
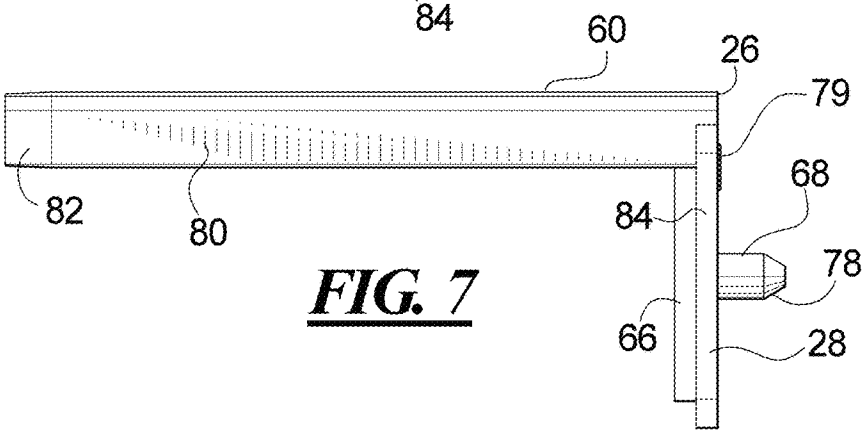
FIG. 7 is a front elevational view of the display holder.

FIG. 7 shows that the display holder 26 has an L shape with the sign gripper 28 forming one leg of the L on one hand and on the other hand the mounting plate 60 and disengagement flange 80 forming the second leg of the L. The sign gripper 28 is at the right end of the mounting plate and disengagement flange 80. It is foreseeable that the display holder may be formed in a mirror image configuration with the sign gripper 28 at the left end of the mounting plate 60 and disengagement flange 80. The taper 82 is provided at the end of the disengagement flange 80 as well as at the end of the mounting plate 60. The finger tab 66 extends from the sign gripper 28 in an opposite direction from the peg 68. In the illustration, the indicia 79 is embossed raised lettering that extends from the surface of the fixed portion 84.

Figure 8:
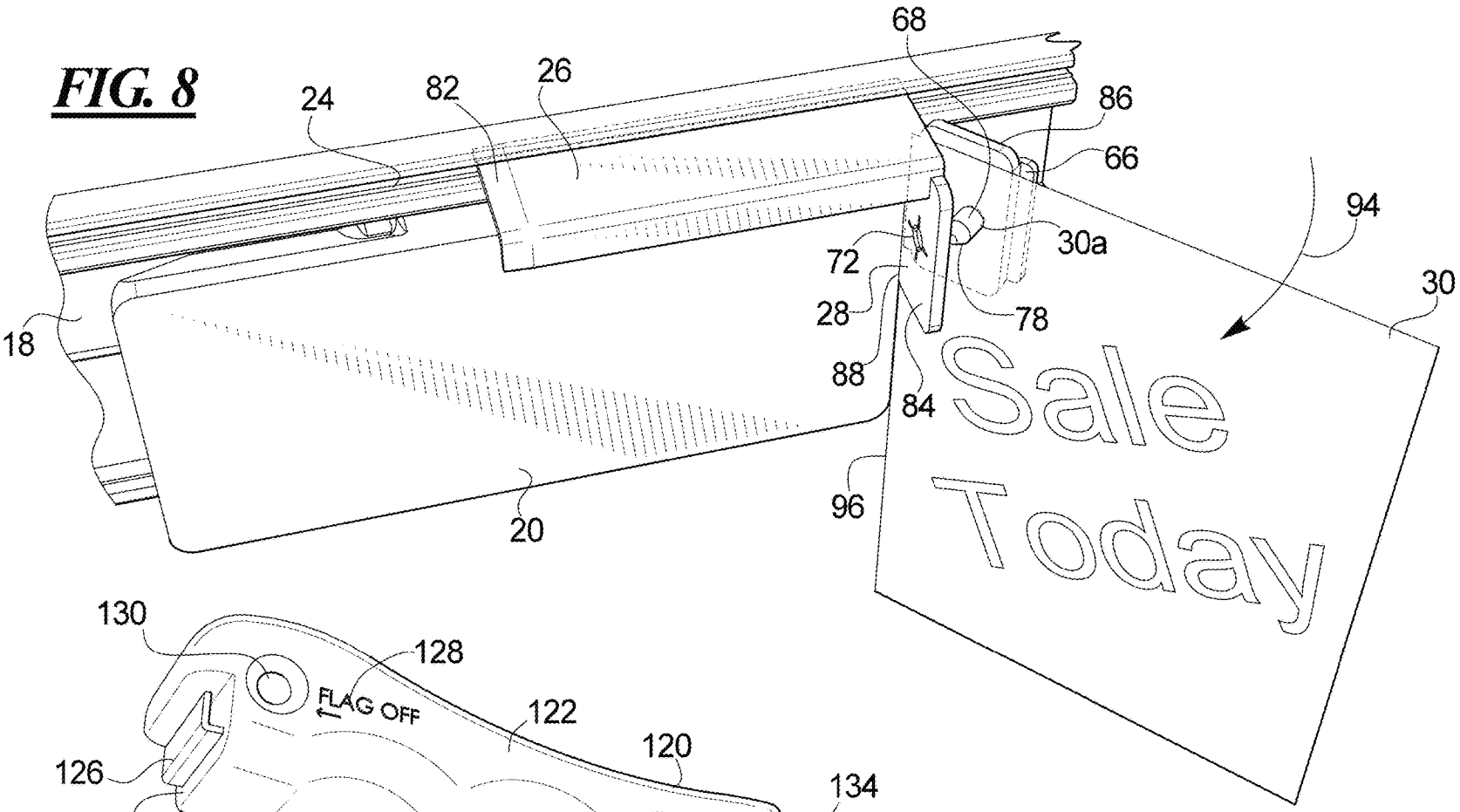
FIG. 8 is a perspective view from the top front showing an electronic shelf label module and the display holder mounted in a channel and showing a sign or display being mounted in the display holder.

Turning to FIG. 8, the electronic shelf label module 20 is mounted in the channel 18 near to a product display, such as on a front edge of a shelf, on a wall, cabinet, or other location. Store personnel wish to flag the product and/or the electronic shelf label module 20 for that product for special attention. The store personnel have inserted the display holder 26 into the display mounting channel 24 with the sign gripper 28 at the right-hand end of the electronic shelf label module 20. The sign or display 30 is positioned between the fixed portion 84 and movable portion 86 of the sign gripper 28. In the illustration, a hole 30*a* is provided in the sign or display 30 and the peg 68 has been inserted through the hole 30*a* in the sign or display 30. The movable portion 86 is then pivoted about the hinge 88 in the direction of the arrow 94 to insert the peg 68 into the hole 72 in the fixed portion 84. The peg 68 is securely held in the hole 72 to secure the sign or display 30 in the sign gripper 28.

If no hole 30*a* is provided in the sign or display 30, the conical end 78 of the peg 68 may punch a hole 30*a* through the sign or display 30 as the peg 68 is inserted into the hole 72 in the fixed portion 84. In an example, the peg 68 may be used to punch a hole through a sign or display 30 formed of paper, cardboard or other materials by squeezing the movable portion 86 and the fixed portion 84 together with the sign or display 30 between the portions 84 and 86. The peg 68 and hole 72 operate as a punch to form the hole 30*a* through the sign or display 30. The hole 30*a* formed by the peg 68 and hole 72 is of the same diameter as the peg 68. By ensuring that the diameter of the hole 30*a* is the same as the diameter of the peg and thus fits tightly on the peg 68, the sign or display 30 is prevented from shifting in the sign holder 26.

The user may ensure that the sign or display 30 does not rotate in the sign gripper 28 by locating a rear edge 96 of the sign or display 30 at or near the hinge 88 when forming the hole 30*a* using the peg 68 and hole 72 or when providing the hold 30*a* by other means. The rear edge 96 of the sign or display 30 is at or near the hinge 88 when the sign or display 30 is in the sign gripper 28, the edge 96 of the sign engages the hinge 88 and prevents the sign or display 30 from rotating about the peg 68 while held in the sign gripper 28. The sign or display 30 may be prevented from shifting and from rotating by the present sign gripper 28.

When the sign or display 30 is secured in the sign gripper 28, the sign or display 30 extends perpendicular to the channel 18 and perpendicular to the electronic shelf label module 20. The perpendicular sign or display 30 is positioned for viewing when the customer looks down an aisle of the store, yet does not block the view of the product or the view of the electronic shelf label module 20 when the customer is at the product display.

A rectangular sign or display 30 is shown, but the sign or display 30 may be of any shape or color, may be provided with text or graphics or photos or any combination of text and graphics and photos, and may be of any size. For example, the sign or display 30 may be in the shape of the product being promoted.

When the sign or display 30 is to be removed or to be changed for another sign or display 30, the finger tab 66 which extends from the movable portion 86 may be engaged, such as by a fingertip, finger nail, a tool, or other object and pivoted away from the fixed portion 84. The peg 68 pulls out of the hole 72 and the movable portion 86 moves in a direction opposite to the arrow 94 to open the sign gripper 28. The peg 68 is removed from the hole 30*a*. The sign or display 30 may be removed or exchanged for another sign or display 30.

Figure 9:
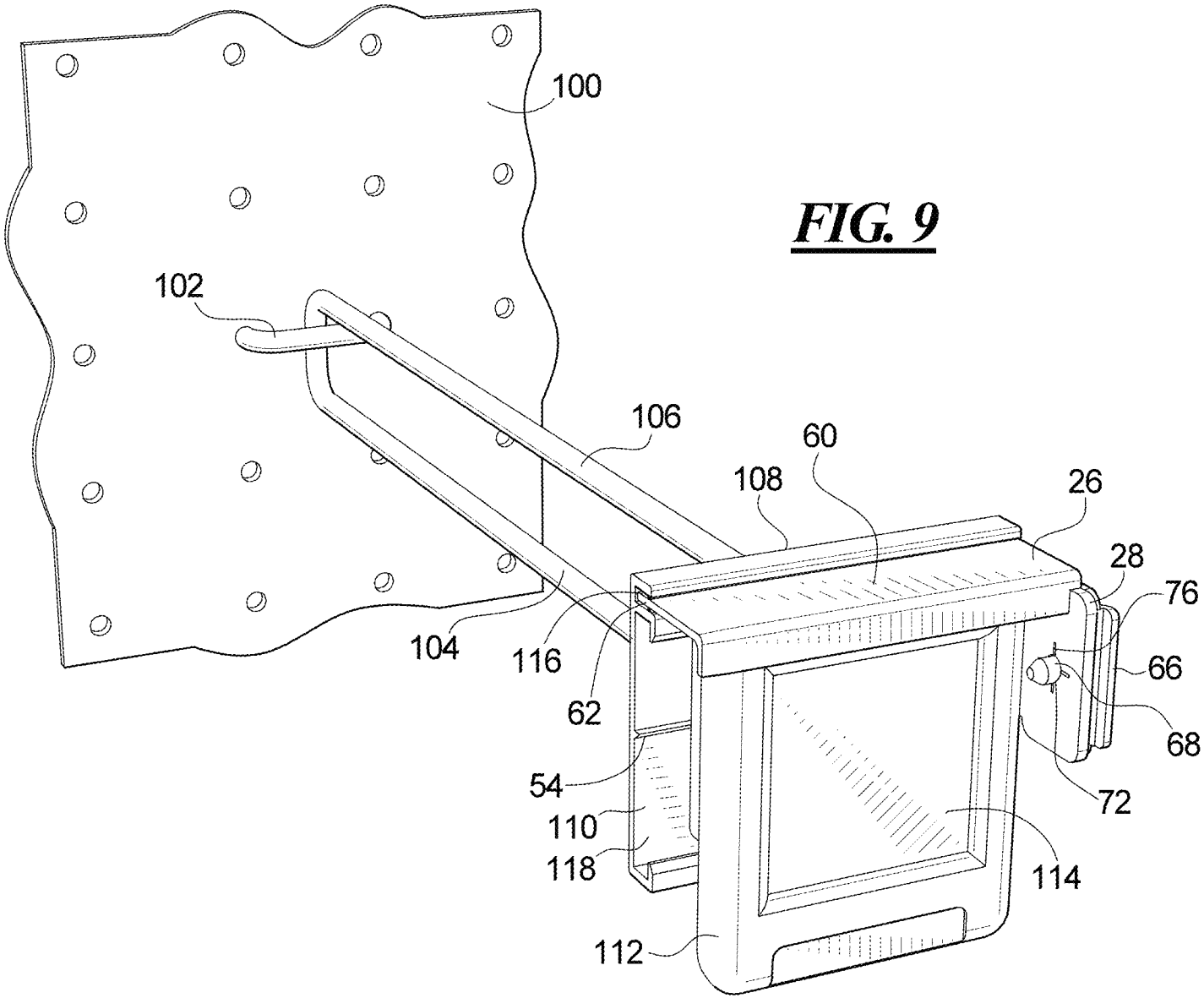
FIG. 9 is a perspective view from the top front left side of a pegboard hook with a scan plate to which is mounted a channel holding an electronic shelf label module and a display holder.

Turning to FIG. 9, a pegboard 100, slat board, or other display mounting structure in a store or other facility has been provided with a pegboard hook 102 on which products may be hung for display. The pegboard hook 102 includes a lower product holding hook 104 extending from the pegboard 100. An upper rod 106 extends parallel to and above the lower product holding hook 104. The upper rod 106 has a scan plate 108 at its free end that extends beyond the product holding hook 104. A channel 110 is attached to the front surface of the scan plate 108. The channel 110 may be of the same configuration as the channel 18 described in this specification, except that the channel 110 is shorter for mounting on the short scan plate 108 rather than being longer for mounting on long front edges of a shelf or other long structure. The channel 18 or 110 may be formed in any length desired and may be configured to fit onto shorter or longer mounting locations as needed.

An electronic shelf label module 112 has been mounted in the channel 110. The electronic shelf label module 112 is shorter than the electronic shelf label modules 20 shown in prior figures and may be used in channels 110 mounted on scan plates or at other shorter mounting locations as desired. The electronic shelf label module 112 has a display screen 114 on which is displayed price and product information for the products that may be suspended from the product holding hook 104. Like other electronic shelf label modules, the displayed price and product information may be changed from a central location by wirelessly transmitting the updated information to the electronic shelf label module 112.

The channel 110 has a display mounting channel 116 above the first portion 118 of the channel 110 in which the electronic shelf label module 112 is mounted. The display holder 26 as described above has been inserted into the display mounting channel 116. The sign gripper 28 of the display holder 26 is shown in the closed position. A sign or display 30 may be held in the sign gripper 28 in the closed position to flag the product for attention by customers. The display holder 26 may be used regardless of the length of the channel 18 or 110 or its mounting location.

The sign gripper 28 may extend beyond the end of the channel 110 when the engagement edge 62 is mounted in the display mounting channel 116, particularly for channels 110 that are short. Because the end of the channel 110 is near the location where the display holder 26 is to be mounted, the engagement edge 62 may be mounted in the display mounting channel 116 either by inserting the mounting plate 60 into the display mounting channel 116 either from the front as with longer channels 18, or may be inserted into the end of the display mounting channel 116 at the end of the channel 110. The taper 82 facilitates insertion of the engagement edge 62 into the end of the display mounting channel 116. The taper 82 may also facilitate insertion of the engagement edge 62 into the front of the display mounting channel 116. The user may start the insertion at the taper 82 with the display holder 26 at a slight angle, which eases initial entry of the engagement edge 62 into the display mounting channel 116 or 24.

Figure 10:
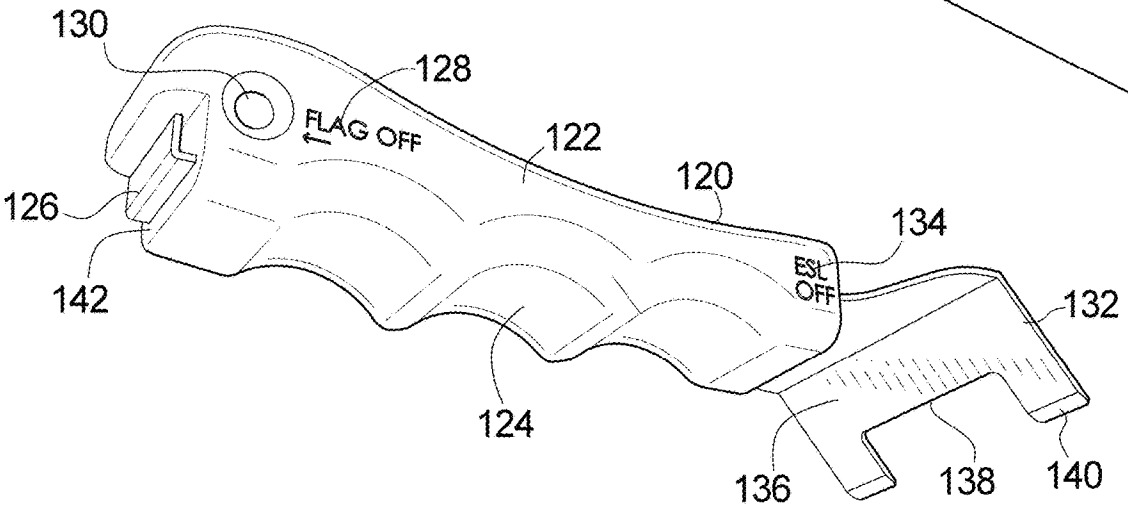
FIG. 10 is a perspective view from the bottom right side of a tool for removing the display holder and the electronic shelf label module from the channel.

Turning back to the previous sheet, FIG. 10 shows a tool 120 for use by store personnel or others when changing the displays. The tool 120 has a hand grip 122 with finger scallops 124 along the bottom. At the left end of the tool 120 in this view is provided a flag off tool 126 that may be used to remove a display holder 26 from the display holding channel 24 or 116. The flag off tool 126 is indicated by indicia 128 on the hand grip 122. In the illustration, the indicia is an arrow and the words "flag off." A hang hole 130 extends through the hand grip 122 at the end adjacent to the flag off tool 126. The tool 120 may be hung on a hook or nail using the hang hole 130, or a lanyard may be passed through the hang hole 130. The opposite end of the tool 120 has an ESL off tool 132 that may be used to remove an electronic shelf label module 20 or 112 from the channel 18 or 110. Indicia 134 is provided on the hand grip 122 to indicate the ESL off tool 132. In the illustration, the indicia 134 includes an arrow and the words "ESL off." The indicia 128 and 134 may be formed by raised lettering, recessed lettering, printing, embossing or other means. The ESL off tool 132 includes a blade with an angled forward portion 136. The forward portion 136 defines a notch 138. The end most edge of the forward portion includes a bevel 140.

Figure 11:
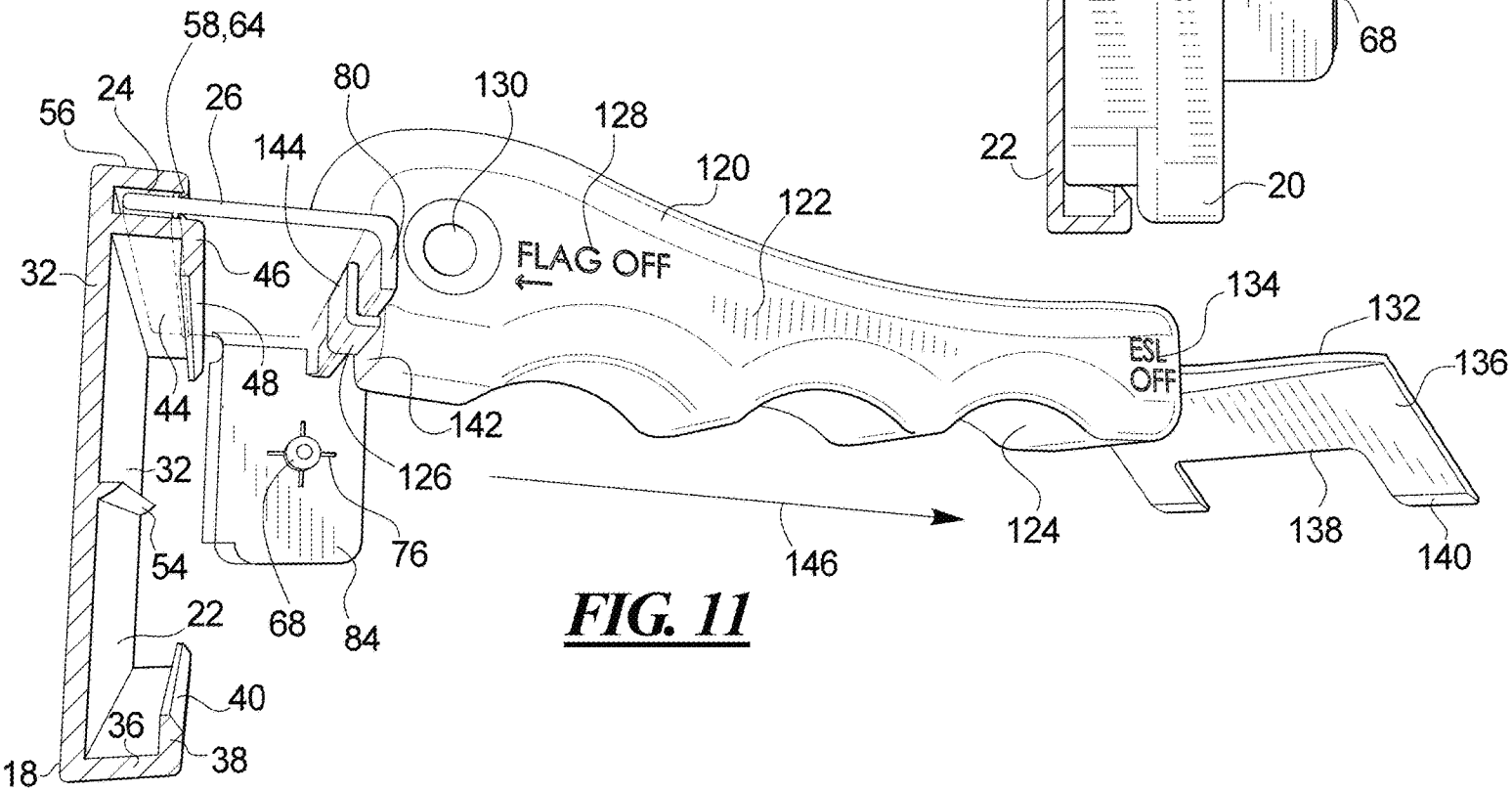
FIG. 11 is a side perspective view of the tool removing the display holder from the channel.

With reference to FIG. 11, the channel 18 has a display holder 26 mounted in the display holding channel 24. The gripping ribs 58 and 64 on the display holder 26 and in the display holding channel 24 engage one another to inhibit removal of the display holder 26 from the display holding channel 24. In an example, the display holder 26 is quite difficult to remove from the display holding channel 24 without a tool due to the gripping ribs 58 and 64. In the figure, the flag off tool 126 has been engaged onto the disengagement flange 80 of the display holder 26. In detail, the flag off tool 126 includes an L-shaped projection 144 that extends from a notch 142 at the end of the hand grip 22 to form an L-shaped recess. The L-shaped projection of an embodiment is of steel and the handgrip 122 is of plastic, although other materials are possible. The L-shaped disengagement flange 80 is inserted into the L-shaped recess formed by the notch 142 and L-shaped projection 144 so that the L-shaped projection 144 has a leg behind the disengagement flange 80. Once in position, a disengagement force is exerted in the direction of the arrow 146, such as by gripping the hand grip 122 and pulling. The display holder 26 is thereby removed from the channel 18. Removal may be facilitated by pulling the tool 120 at an angle so that the tapered end 82 of the engagement edge 62 is released first from the display holding channel 24.

The flag off tool 126 may be positioned onto the disengagement flange 80 by sliding the L-shaped recess of the tool 120 onto the tapered end 82 of the disengagement flange 80. The tapered end 82 facilitates engagement of the flag off tool 126 on the disengagement flange 80.

FIG. 11 shows the first portion 22 of the channel 18 without an electronic shelf label module. The resilient fin 54 extends from the backplane 32. The resilient fin 54 is triangular in shape to provide increasing resistance as the electronic shelf label module 20 presses and flattens the resilient fin 54. In the illustrated embodiment, the resilient fin 54 is in a shape of a right triangle. A top surface of the resilient fin 54 extends perpendicular to the backplane 32 and a lower surface of the resilient fin 54 is at an acute angle to the backplane 32. The lower surface of the resilient fin 54 may be curved for example in the shape of a convex curve or may have other shapes. The shape of the resilient fin 54 may result in the fin 54 folding toward the perpendicular top surface of the fin as the electronic shelf label module 20 is inserted. The resilient fin 54 may both compress and fold when the electronic shelf label module 20 is inserted into the channel 18. The resilient fin 54 presses the electronic shelf label module 20 forward against the upward and downwardly directed flanges 38 and 46, ensuring that the electronic shelf label module 20 is held without movement and is not loose in the channel 18. The resilient fin 54 may be coextruded with the channel 18 and may be formed of a high friction material such as PVC plastic. The high friction engagement of the fin 54 against the back of the electronic shelf label module 20 prevents or inhibits the electronic shelf label module 20 from being slid along the channel 18.

Figure 12:
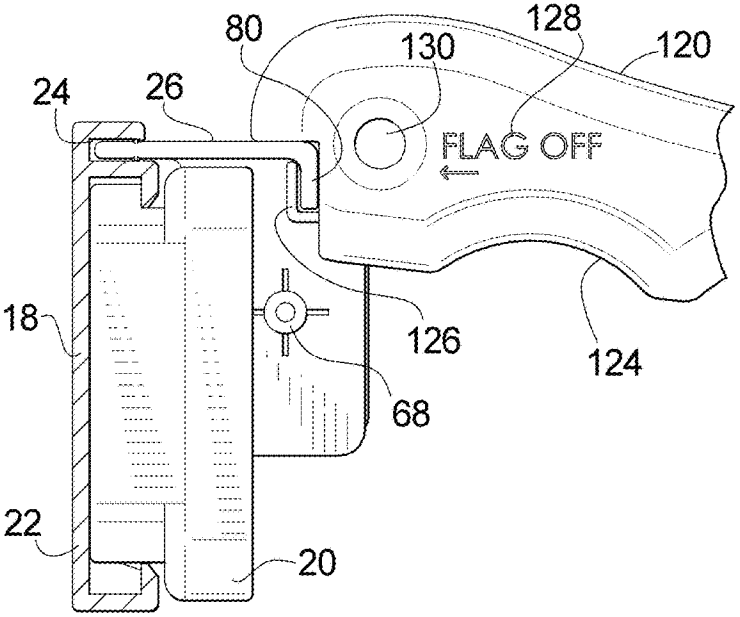
FIG. 12 is a fragmentary side elevational view of the tool removing the display holder while an electronic shelf label module is mounted in the channel.

In FIG. 12, the channel 18 has the electronic shelf label module 20 mounted in the first portion 22. The display holder 26 is mounted in the display channel 24 above the electronic shelf label module 20. The flag off tool 126 has been attached to the display holder 26 without interference from the electronic shelf label module 20. The tool 120 may be used to remove the display holder 26 while leaving the electronic shelf label module 20 in place and undisturbed. The tool 120 may be used to remove the display holder 26 from the channel 18 when different sizes and shapes of electronic shelf label modules 20, 20*b* or 112 are mounted in the channel 18, 18*a* or 110.

Figure 13:
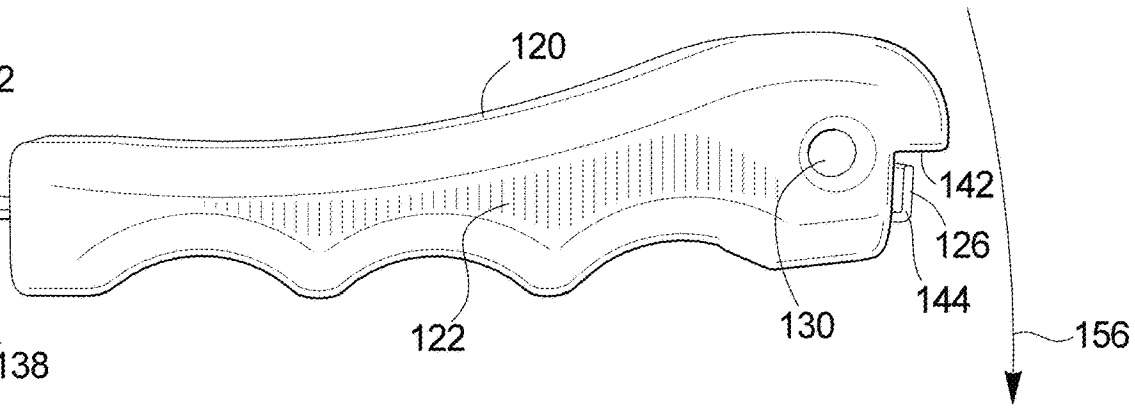
FIG. 13 is a perspective view from the top front right side of the tool showing the blade for removing electronic shelf label modules from the channel.
Figure 13:
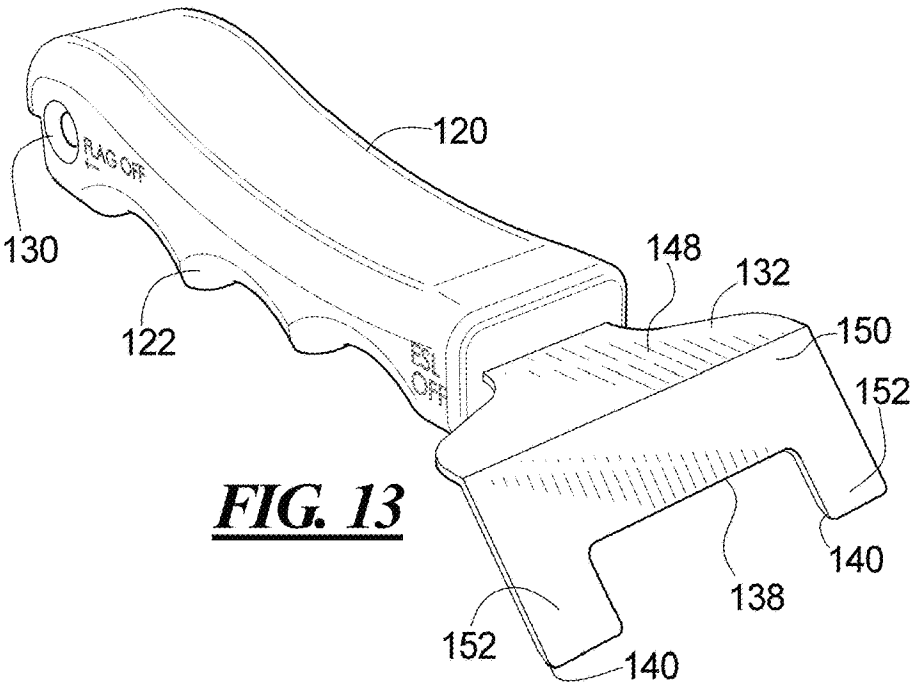

Progressing to FIG. 13, the tool 120 has the ESL off tool 132 at the forward end. The ESL off tool 132 includes a blade of steel or other durable material. A proximal portion 148 extends from the hand grip 122 generally along the plane of the hand grip 122. A distal portion 150 is angled downwardly from the proximal portion 148. The distal portion 150 includes two lateral extensions 152 that are spaced apart to define a gap or notch 138. The gap or notch 138 is dimensioned to fit over a top projection of the electronic shelf label module 20. The two lateral projections 152 have bevels 140 along the forward edge, as is better seen in FIGS. 10 and 11.

Figure 14:
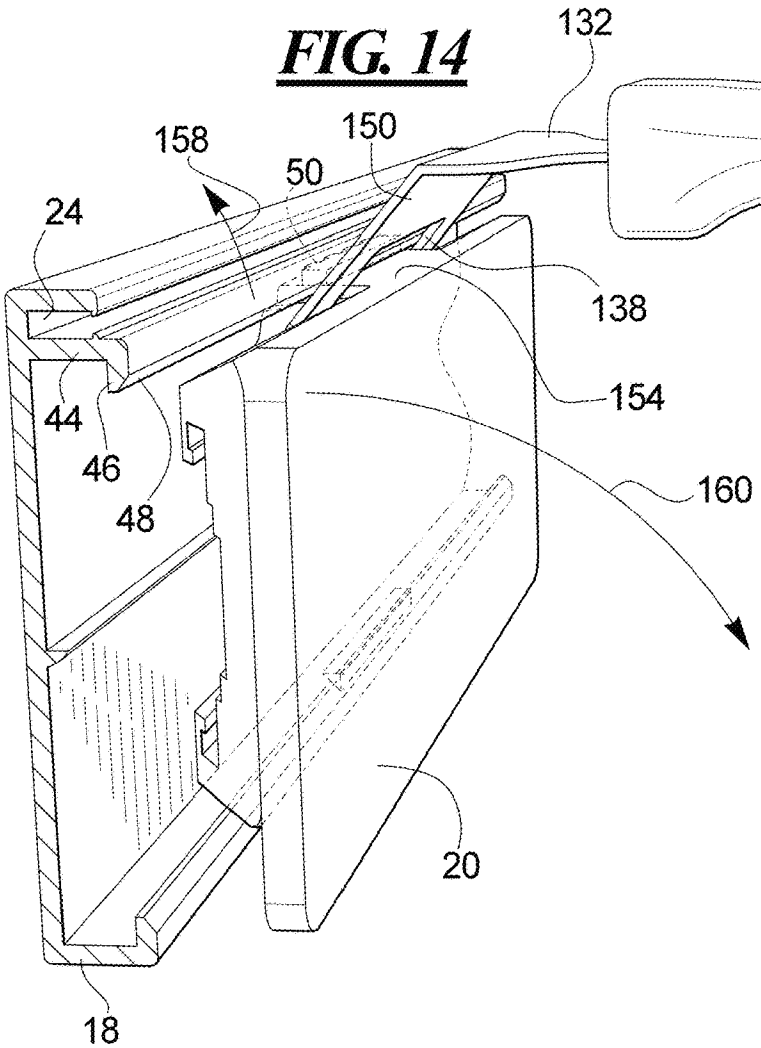
FIG. 14 is a perspective view from the left side showing the tool being used to remove an electronic shelf label module from the channel.

In FIG. 14, the beveled front edges 140 of the ESL off tool 132 have been inserted between the top of the electronic shelf label module 20 and the downwardly directed gripping flange 46 of the channel 18. The bevel 140 on the front edge of the tool 132 and the forward bevel 48 on the downwardly directed gripping flange 46 facilitates the insertion of the tool 132 into the position. The lateral extensions 152 are positioned on either side of a center projection 154 of the electronic shelf label module 20, 20*b* on which is provided the top projection 50, 50*a* that is held by the downwardly directed flange 46. Said another way, the center projection 154 of the electronic shelf label module 20 is positioned in the gap or notch 142 between the lateral extensions 152. Once in the illustrated position, the tool 120 is pivoted in the direction of arrow 156 to lift the upper ledge 44 of the channel 18 in the direction of arrow 158 and out of engagement with the top projection 50, 50*a* of the electronic shelf label module 20, 20*b*. The electronic shelf label module 20 may be pivoted in the direction of arrow 160 so that the electronic shelf label module 20 is released from the channel 18.

Figure 15:
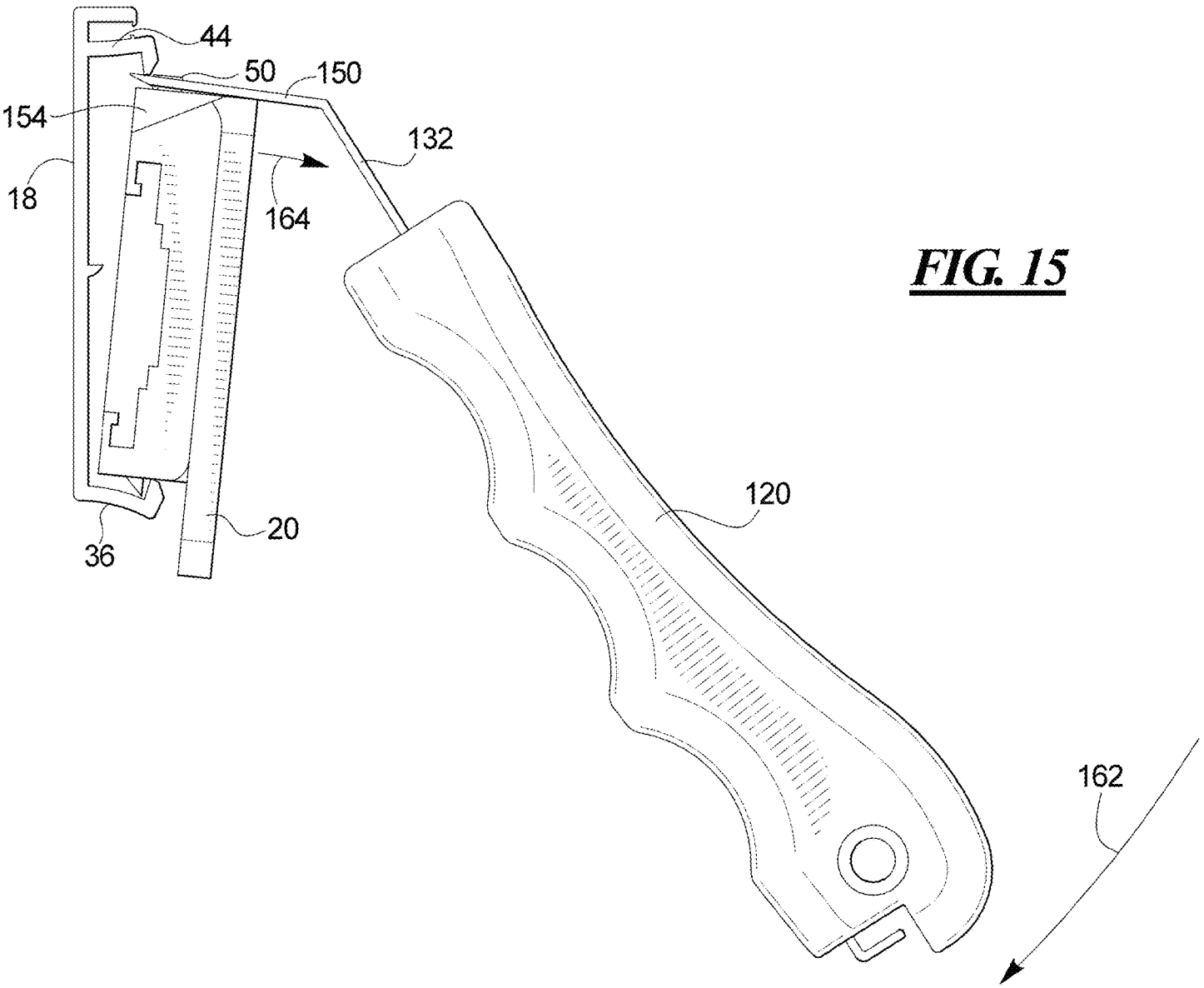
FIG. 15 is a side elevational view showing the electronic shelf label module released from the channel by the tool.

In further detail, FIG. 15 shows the tool 120 as it is pivoted in the direction of arrow 162. The upper ledge 44 of the channel 18 has been flexed and lifted clear of the top projection 50, 50*a* of the electronic shelf label module 20, 20*b*. The lower ledge 36 of the channel 18 may also flex downward as a result of downward pressure on the electronic shelf label module 20 by the tool 120 to help clear the top projection 50 from the channel 18. The electronic shelf label module 20 is released, as indicated by arrow 164. Once released, the electronic shelf label module 20 may be mounted at a product display in a different location, may be stored for use later, may be serviced such as having the battery replaced or other service performed, or may be upgraded to a different model.

The tool 120 is shown as including the flag off tool 126 and the ESL off tool 132 mounted at opposite ends of the same handgrip 122. Other configurations are possible, including providing the flag off tool 126 and the ESL off tool 132 as separate tools, each with their own handgrips.

The apparatus, system and method may be provided in various aspects.

In a first aspect, an apparatus for mounting an electronic shelf label, comprises: a first channel portion configured for receiving an electronic shelf label module, the first channel portion including a back plane and first and second gripping flanges extending from the back plane, the first and second gripping flanges being shaped to engage the electronic shelf label module; and a second channel portion including a third gripping flange extending parallel to the first gripping flange, the second channel portion defining a display mounting channel between the first and third gripping flanges.

In a second aspect, an apparatus of the first aspect, further comprising: a first gripping rib on the first gripping flange extending into the display mounting channel toward the third gripping flange; and a second gripping rib on the third gripping flange extending into the display mounting channel toward the first gripping flange.

In a third aspect, an apparatus of the first aspect, further comprising: a display holder having a mounting plate, the mounting plate including an engagement edge configured to fit into the display mounting channel of the second channel portion; and a sign gripper connected to the mount plate, the sign gripper being configured for selectively gripping a sign.

In a fourth aspect, an apparatus of the third aspect, further comprising: a mounting plate gripping rib on the mounting plate parallel to the engagement edge of the mounting plate;

and a flange gripping rib on one of the first and third gripping flanges, the flange gripping rib being configured to engage the mounting plate gripping rib when the engagement edge of the mounting plate is fit into the display mounting channel of the second channel portion.

In a fifth aspect, an apparatus of the third aspect, further comprising: a disengagement flange extending from the mounting plate at an edge of the mounting plate opposite the engagement edge, the disengagement flange being configured for gripping during disengagement of the display holder from the display mounting channel.

In a sixth aspect, an apparatus of the fifth aspect, further comprising: a tool having a handle, the tool including a disengagement flange receiver configured for receiving the disengagement flange of the display holder, the tool being operable to exert a disengagement force on the display holder to disengage the display holder from the display mounting channel.

In a seventh aspect, an apparatus of the sixth aspect, wherein the disengagement flange of the display holder is L-shaped in cross section, and wherein the disengagement flange receiver of the tool includes defines an L-shaped opening configured to receive the L-shaped disengagement flange.

In an eighth aspect, an apparatus of the sixth aspect, further comprising: a blade extending from the handle of the tool, the blade being configured for insertion between the electronic shelf label module and one of the first and second gripping flanges, the tool being operable to disengage the electronic shelf label module from the first channel portion.

In a ninth aspect, an apparatus of the eighth aspect, wherein the blade includes first and second blade portions spaced apart from one another by a predetermined distance.

In a tenth aspect, an apparatus of the eighth aspect, wherein the blade has a beveled end and the first and second gripping flanges have beveled edges, the beveled end of the blade being configured to engage the beveled edge of one of the first and second gripping flanges when the tool is positioned to release the electronic shelf label module from the first channel portion.

In an eleventh aspect, an apparatus of the eighth aspect, wherein the blade extends from a first end of the handle of the tool and wherein the disengagement flange receiver is at a second opposite end of the handle of the tool.

In a twelfth aspect, an apparatus of the third aspect, wherein the sign gripper includes first and second gripper portions connected to one another by a hinge, the hinge being operable to permit first pivoting movement of the first and second gripper portions toward one another to a gripping position for gripping the sign between the first and second gripper portions and to permit second pivoting movement of the first and second gripping portions away from one another for releasing the sign, the sign gripper being configured to hold the sign perpendicular to the first and second channel portions.

In a thirteenth aspect, an apparatus of the twelfth aspect, wherein the first gripper portion includes a peg and wherein the second gripper portion defines an opening configured to receive the peg when the first and second gripper portions are in the gripping position, the peg being configured to extend through an opening in the sign when the sign is between the first and second gripper portions in the gripping position.

In a fourteenth aspect, an apparatus of the thirteenth aspect, wherein the peg includes a conical end configured for perforating the sign as the first and second gripper portions are moved toward the gripping position.

In a fifteenth aspect, an apparatus of the twelfth aspect, further comprising: a finger tab extending from the second gripper portion, the finger tab being configured to receive a release force to move the first and second gripper portions away from one another in the second pivoting movement.

In a sixteenth aspect, an apparatus of the third aspect, wherein the engagement edge of the display holder is tapered adjacent an end of the mounting plate; and further comprising: a mounting plate gripping rib on the mounting plate parallel to the engagement edge of the mounting plate, the mounting plate gripping rib being tapered adjacent the end of the mounting plate; and a disengagement flange extending from the mounting plate at an edge of the mounting plate opposite the engagement edge, the disengagement flange being tapered adjacent the end of the mounting plate.

In a seventeenth aspect, an apparatus of the third aspect, wherein the sign gripper is connected at an end of the mounting plate of the display holder.

In an eighteenth aspect, an apparatus of the seventeenth aspect, further comprising: a disengagement flange extending from the mounting plate at an edge of the mounting plate opposite the engagement edge, the sign gripper being connected to an end of the disengagement flange.

In a nineteenth aspect, a system for holding an electronic shelf label, comprising: a bracket having a first channel portion configured to hold an electronic shelf label module and having a second channel portion adjacent to the first channel portion; a display holder having a mounting plate configured for engagement in the second channel portion, the display holder having a sign gripper configured to hold a sign perpendicular to the first and second channel portions, the display holder having a disengagement flange along an edge of the mounting plate; and a tool having a blade at a first end configured to facilitate removal of the electronic shelf label module from the first channel portion, the tool having a disengagement flange receiver at an opposite end from the blade, the disengagement flange receiver being configured to receive the disengagement flange of the display holder.

In a twentieth aspect, a method for flagging a product, comprising: mounting an electronic price label module in a first channel portion of an electronic price label mount, the electronic price label module displaying information about a product; mounting a display holder in a second channel portion of the electronic price label mount, the mounting including inserting a mounting plate of the display holder into the second channel portion above or below the electronic price label module; and fastening a sign or display in the display holder in a position perpendicular to the first and second channel portions to flag the product.

In a twenty-first aspect, a method of the twentieth aspect, further comprising: mounting the electronic price label mount at a product display location.

In a twenty-second aspect, a method of the twentieth aspect, wherein the fastening the sign or display includes pivoting a first gripper portion toward a second gripper portion with a portion of the sign or display positioned between the first gripper portion and the second gripper portion.

In a twenty-third aspect, a method of the twenty-second aspect, further comprising: inserting a peg of the first gripper portion through an opening in the sign or display and through an opening in the second gripper portion as the first gripper portion is moved toward the second gripper portion.

In a twenty-fourth aspect, a method of the twenty-third aspect, further comprising: forming the opening in the sign or display as the peg is inserted through the sign or display.

In a twenty-fifth aspect, a method of the twentieth aspect, further comprising: removing the sign or display from the display holder.

In a twenty-sixth aspect, a method of the twentieth aspect, further comprising: disengaging the display holder from the second channel portion using a display holder disengagement tool.

In a twenty-seventh aspect, a method of the twenty-sixth aspect, further comprising: removing the electronic shelf label module from the first channel portion using the display holder disengagement tool.

In a twenty-eighth aspect, a method of the twentieth aspect, further comprising: mounting a second electronic price label module in the first channel portion adjacent the first electronic price label module; and positioning the display holder so that the sign or display is between the first and second electronic price label modules.

In a twenty-ninth aspect, a method of the twentieth aspect, as claimed in claim 10, further comprising: mounting the channel on a scan plate of a pegboard mount.

Thus, there is shown and described an apparatus, system and method for mounting and removing electronic shelf label (ESL) modules includes a channel having a first portion for receiving an ESL module and a second portion for receiving a display holder. A tool aids in removal of the ESL from the first portion and aids in removal of the display holder from the second portion. The display holder has an engagement edge that fits into the second channel and a sign gripper with a movable portion connected to a fixed portion. A peg on the movable portion extends through the sign and into a hold in the fixed portion.

Although other modifications and changes may be suggested by those skilled in the art, it is the intention of the inventors to embody within the patent warranted hereon all changes and modifications as reasonably and properly come within the scope of their contribution to the art.

We claim:

1. An apparatus for mounting an electronic shelf label, comprising:

a first channel portion configured for receiving an electronic shelf label module, the first channel portion including a back plane and first and second gripping flanges extending from the back plane, the first and second gripping flanges being shaped to engage the electronic shelf label module;

a second channel portion including a third gripping flange extending parallel to the first gripping flange, the second channel portion defining a display mounting channel between the first and third gripping flanges; and a display holder including:

a mounting plate having an engagement edge configured to fit into the display mounting channel of the second channel portion; and a sign gripper connected to an end of the mount plate and configured to selectively grip a sign.

2. An apparatus as claimed in claim 1, further comprising:

a first gripping rib on the first gripping flange extending into the display mounting channel toward the third gripping flange; and a second gripping rib on the third gripping flange extending into the display mounting channel toward the first gripping flange.

3. An apparatus as claimed in claim 1, further comprising:

a mounting plate gripping rib on the mounting plate parallel to the engagement edge of the mounting plate; and a flange gripping rib on one of the first and third gripping flanges, the flange gripping rib being configured to engage the mounting plate gripping rib when the engagement edge of the mounting plate is fit into the display mounting channel of the second channel portion.

4. An apparatus as claimed in claim 1, further comprising:

a disengagement flange extending from the mounting plate at an edge of the mounting plate opposite the engagement edge, the disengagement flange being configured for gripping during disengagement of the display holder from the display mounting channel.

5. An apparatus as claimed in claim 4, further comprising:

a tool having a handle, the tool including a disengagement flange receiver configured for receiving the disengagement flange of the display holder, the tool being operable to exert a disengagement force on the display holder to disengage the display holder from the display mounting channel.

6. An apparatus as claimed in claim 5, wherein the disengagement flange of the display holder is L-shaped in cross section, and wherein the disengagement flange receiver of the tool includes defines an L-shaped opening configured to receive the L-shaped disengagement flange.

7. An apparatus as claimed in claim 5, further comprising:

a blade extending from the handle of the tool, the blade being configured for insertion between the electronic shelf label module and one of the first and second gripping flanges, the tool being operable to disengage the electronic shelf label module from the first channel portion.

8. An apparatus as claimed in claim 7, wherein the blade includes first and second blade portions spaced apart from one another by a predetermined distance.

9. An apparatus as claimed in claim 7, wherein the blade has a beveled end and the first and second gripping flanges have beveled edges, the beveled end of the blade being configured to engage the beveled edge of one of the first and second gripping flanges when the tool is positioned to release the electronic shelf label module from the first channel portion.

10. An apparatus as claimed in claim 7, wherein the blade extends from a first end of the handle of the tool and wherein the disengagement flange receiver is at a second opposite end of the handle of the tool.

11. An apparatus as claimed in claim 1, wherein the sign gripper includes first and second gripper portions connected to one another by a hinge, the hinge being operable to permit first pivoting movement of the first and second gripper portions toward one another to a gripping position for gripping the sign between the first and second gripper portions and to permit second pivoting movement of the first and second gripping portions away from one another for releasing the sign, the sign gripper being configured to hold the sign perpendicular to the first and second channel portions.

12. An apparatus as claimed in claim 11, wherein the first gripper portion includes a peg and wherein the second gripper portion defines an opening configured to receive the peg when the first and second gripper portions are in the gripping position, the peg being configured to extend through an opening in the sign when the sign is between the first and second gripper portions in the gripping position.

13. An apparatus as claimed in claim 12, wherein the peg includes a conical end configured for perforating the sign as the first and second gripper portions are moved toward the gripping position.

14. An apparatus as claimed in claim 11, further comprising:

a finger tab extending from the second gripper portion, the finger tab being configured to receive a release force to move the first and second gripper portions away from one another in the second pivoting movement.

15. An apparatus as claimed in claim 1, wherein the engagement edge of the display holder is tapered adjacent an end of the mounting plate; and further comprising:

a mounting plate gripping rib on the mounting plate parallel to the engagement edge of the mounting plate, the mounting plate gripping rib being tapered adjacent the end of the mounting plate; and a disengagement flange extending from the mounting plate at an edge of the mounting plate opposite the engagement edge, the disengagement flange being tapered adjacent the end of the mounting plate.

16. An apparatus as claimed in claim 1, further comprising:

a disengagement flange extending from the mounting plate at an edge of the mounting plate opposite the engagement edge, the sign gripper being connected to an end of the disengagement flange.

17. A system for holding an electronic shelf label, comprising:

a bracket having a first channel portion configured to hold an electronic shelf label module and having a second channel portion adjacent to the first channel portion;

a display holder having a mounting plate configured for engagement in the second channel portion, the display holder having a sign gripper configured to hold a sign perpendicular to the first and second channel portions, the display holder having a disengagement flange along an edge of the mounting plate; and a tool having a blade at a first end configured to facilitate removal of the electronic shelf label module from the first channel portion, the tool having a disengagement flange receiver at an opposite end from the blade, the disengagement flange receiver being configured to receive the disengagement flange of the display holder.

18. A method for flagging a product, comprising:

mounting an electronic price label module in a first channel portion of an electronic price label mount, the electronic price label module displaying information about a product;

mounting a display holder in a second channel portion of the electronic price label mount, the mounting including inserting a mounting plate of the display holder into the second channel portion above or below the electronic price label module; and fastening a sign or display in the display holder in a position perpendicular to the first and second channel portions to flag the product.

19. A method as claimed in claim 18, further comprising:

mounting the electronic price label mount at a product display location.

20. A method as claimed in claim 18, wherein the fastening the sign or display includes pivoting a first gripper portion toward a second gripper portion with a portion of the sign or display positioned between the first gripper portion and the second gripper portion.

21. A method as claimed in claim 20, further comprising:

inserting a peg of the first gripper portion through an opening in the sign or display and through an opening in the second gripper portion as the first gripper portion is moved toward the second gripper portion.

22. A method as claimed in claim 21, further comprising:

forming the opening in the sign or display as the peg is inserted through the sign or display.

23. A method as claimed in claim 18, further comprising:

removing the sign or display from the display holder.

24. A method as claimed in claim 18, further comprising:

disengaging the display holder from the second channel portion using a display holder disengagement tool.

25. A method as claimed in claim 24, further comprising:

removing the electronic shelf label module from the first channel portion using the display holder disengagement tool.

26. A method as claimed in claim 18, further comprising:

mounting a second electronic price label module in the first channel portion adjacent the first electronic price label module; and positioning the display holder so that the sign or display is between the first and second electronic price label modules.

27. A method as claimed in claim 18, further comprising:

mounting the channel on a scan plate of a pegboard mount.

28. An apparatus for mounting an electronic shelf label, comprising:

a first channel portion configured to receive an electronic shelf label module, the first channel portion including a back plane and first and second gripping flanges extending from the back plane, the first and second gripping flanges being configured to engage the electronic shelf label module; and a second channel portion including a third gripping flange extending parallel to the first gripping flange, the second channel portion defining a display mounting channel between the first and third gripping flanges, wherein the first gripping flange and the third gripping flange are configured to cooperatively engage a display holder to hold the display holder in the display mounting channel.

* * * * *